US008962110B2

(12) United States Patent
Garcia

(10) Patent No.: US 8,962,110 B2
(45) Date of Patent: Feb. 24, 2015

(54) FOLDABLE CROSS

(76) Inventor: Julian Garcia, Rowlett, TX (US)

( * ) Notice: Subject to any disclaimer, the term of this patent is extended or adjusted under 35 U.S.C. 154(b) by 215 days.

(21) Appl. No.: 13/187,331

(22) Filed: Jul. 20, 2011

(65) Prior Publication Data

US 2013/0022762 A1 Jan. 24, 2013

(51) Int. Cl.
*B65D 8/14* (2006.01)
*A47G 33/02* (2006.01)

(52) U.S. Cl.
CPC ..... *A47G 33/02* (2013.01)
USPC ..... 428/12; 428/3

(58) Field of Classification Search
CPC ..... B65D 11/186; B65D 11/1833
See application file for complete search history.

(56) References Cited

U.S. PATENT DOCUMENTS

| | | | | |
|---|---|---|---|---|
| 1,507,195 | A * | 9/1924 | Moore | 40/551 |
| 4,010,865 | A * | 3/1977 | Wilgus | 220/6 |
| 6,276,523 | B2 * | 8/2001 | Sanders | 206/308.1 |
| 7,413,111 | B2 * | 8/2008 | Quaintance et al. | 229/199 |

* cited by examiner

*Primary Examiner* — Adam Krupicka
(74) *Attorney, Agent, or Firm* — Wilson Daniel Swayze, Jr.

(57) ABSTRACT

A cross device may include a bottom wall, a first sidewall being pivotably connected to the bottom wall, a second sidewall being pivotably connected to the bottom wall, a third sidewall being pivotably connected to the bottom wall, a fourth sidewall being pivotably connected to the bottom wall, and a top wall being pivotably connected to the first sidewall. The cross device may be movable between a first position in the form of a cross and a second position in the form of a rectangle.

6 Claims, 7 Drawing Sheets

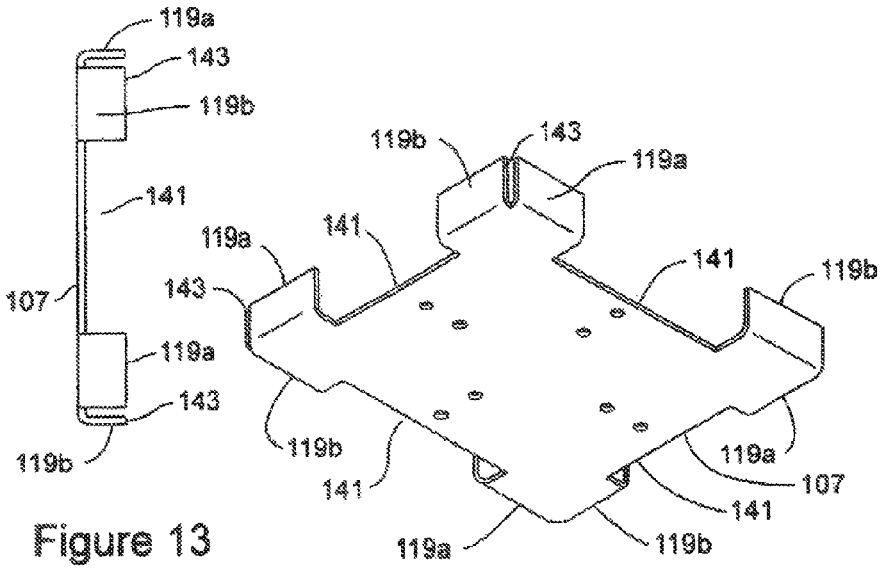
Figure 13
Figure 11
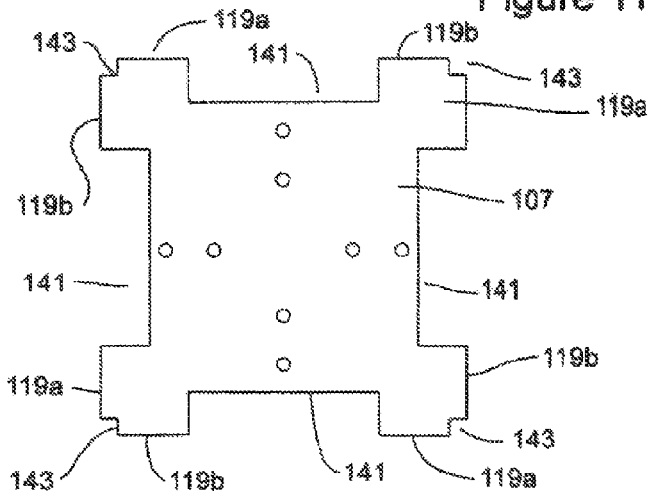
Figure 12
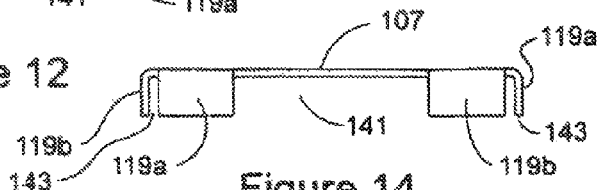
Figure 14

FOLDABLE CROSS

FIELD OF THE INVENTION

The present invention relates to symbols and more particularly to the sign of the cross.

BACKGROUND

One of the most powerful symbols in the Christian world is the symbol of the cross. It is desirable to display this symbol at home, at work, and vehicles, and at school. However, the shape of the cross makes it difficult to transport from location to location and to store the cross while it is being transported. It would be desirable to be able to reduce the size of the cross in order to store or transport the cross.

SUMMARY

A cross device may include a bottom wall, a first sidewall being pivotably connected to the bottom wall, a second sidewall being pivotably connected to the bottom wall, a third sidewall being pivotably connected to the bottom wall, a fourth sidewall being pivotably connected to the bottom wall, and a top wall being pivotably connected to the first sidewall.

The cross device may be movable between a first position in the form of a cross and a second position in the form of a rectangle.

The top wall may be detachably connected to a central frame member, and the first sidewall may be detachably connected to a central frame member.

The second sidewall may be detachably connected to a central frame member, and the third sidewall may be detachably connected to a central frame member.

The fourth sidewall may be detachably connected to a central frame member.

BRIEF DESCRIPTION OF THE DRAWINGS

The invention may be understood by reference to the following description taken in conjunction with the accompanying drawings, in which, like reference numerals identify like elements, and in which:

FIG. 11 illustrates a perspective view of the bottom wall of the cross device of the present invention;

FIG. 12 illustrates a top view of the bottom wall of the cross device of the present invention;

FIG. 13 illustrates a side view of the bottom wall of the cross device of the present invention;

FIG. 14 illustrates another side view of the bottom wall of the cross device of the present invention;

DETAILED DESCRIPTION

The present invention provides a device which is movable/collapsible between a first position which may be in the form of a cross and which may be referred to as an extended position and a second position which may be in the shape of a rectangle and which may be referred to as a stored position.

Figure 1:
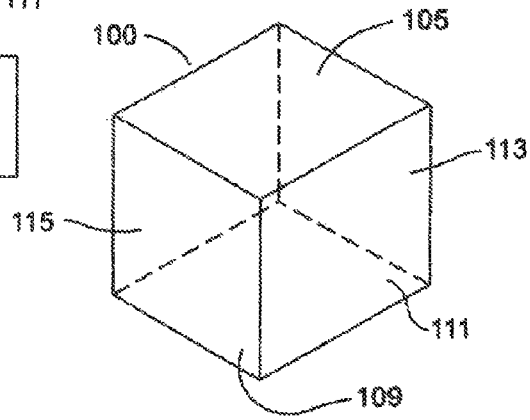
FIG. 1 illustrates a perspective view of the cross device of the present invention in a second position.

FIG. 1 illustrates the collapsible cross device 100 in the second position and may be in the shape of a rectangle, a cube, a square, a sphere, any type of box or other appropriate shape and may be substantially hollow and may be formed from a rigid material such as metal, plastic or other appropriate material and may include a rigid central frame member 101 (not shown in FIG. 1). FIG. 1 illustrates a top wall 105 which may be pivotably connected to a first sidewall 109 and may be adjacent to the second sidewall 111, the third sidewall 113 and the fourth sidewall 115.

FIG. 1 additionally illustrates that the bottom wall 107 may be pivotably connected to the first sidewall 109, the second sidewall 111, the third sidewall, and the fourth sidewall 115. These walls may be rigid and formed from metal, plastic or other suitable material.

The top wall 105 the first sidewall 109, the third sidewall 113 and the fourth sidewall 115 may be pivoted by pneumatics or hydraulics or other devices in order to automatically move the collapsible cross 100 between a first position and a second position.

Figure 2:
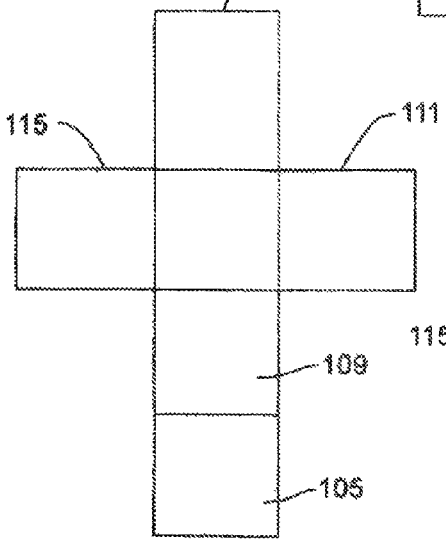
FIG. 2 illustrates a back view of the cross device of the present invention in a first position.

FIG. 2 illustrates a back view and illustrates the device 100 in a first position which being viewed from the back illustrates the cross. FIG. 2 illustrates a top wall 105 which may be pivotably connected to a first sidewall 109 and may be adjacent to the second sidewall 111, the third sidewall 113 and the fourth sidewall 115.

FIG. 2 additionally illustrates that the bottom wall 107 may be pivotably connected to the first sidewall 109, the second sidewall 111, the third sidewall, and the fourth sidewall 115. The top wall 105, the first sidewall 109, the second sidewall 111, the third sidewall 113 and the fourth sidewall 115 have been extended from the position shown in FIG. 1 in order to form the device 100 as a cross.

Figure 3:
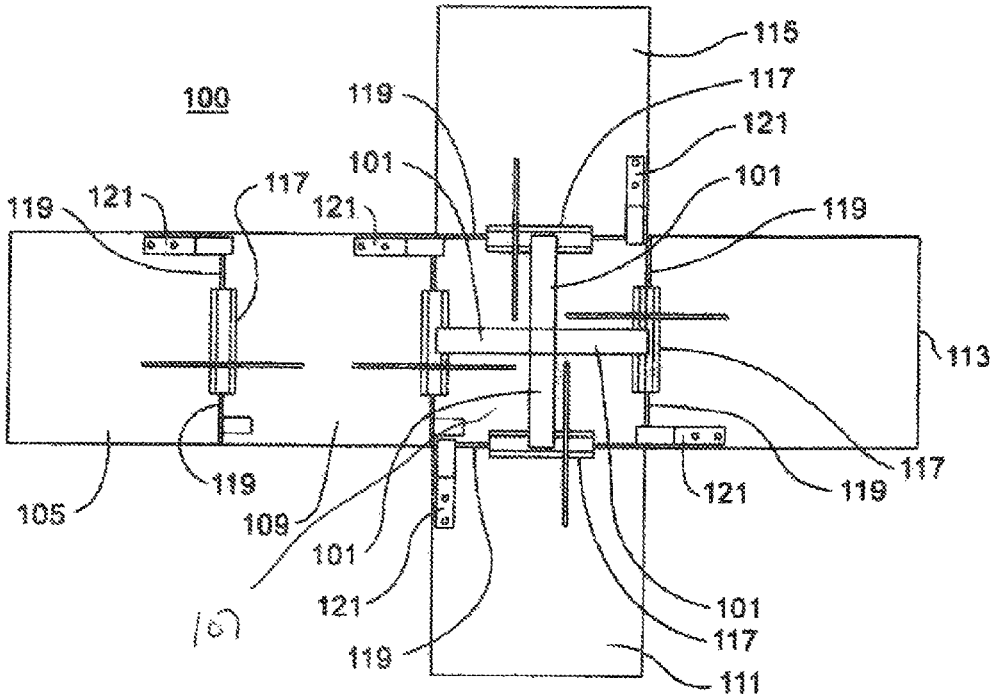
FIG. 3 illustrates a top view of the cross device of the present invention in the first position.

FIG. 3 illustrates a top view of the device 100 and illustrates a multitude of central frame members 101 for example FIG. 3 illustrates four central frame member 101 which are positioned adjacent and opposed at a substantially a 90° angle and 180° angle respectively with respect to a substantially mirror central frame member 101.

FIG. 3 additionally illustrates a hinge 117 which may be substantially a mirrored hinge 117 which may pivotably connected the top wall 105 and which may pivotably connect the first sidewall 109 with the bottom wall 107 and which may pivotably connect the second sidewall 111 with the bottom wall 107 and may pivotably connect the third sidewall 113 with the bottom wall 107 and may pivotably connect the fourth sidewall 115 with the bottom wall 107.

FIG. 3 additionally illustrates that the first sidewall 109 may include first and second upward extending tab 119 along the edge opposing the top sidewall 105; the bottom wall 107 may include another first and second upward extending tab 119 (a mirror) along the edge opposing the first sidewall 109; the bottom wall 107 may include another first and second upward extending tab 119 (a mirror) along the edge opposing the second sidewall 111; the bottom wall 107 may include the first and second upward extending tab 119 along the edge opposing the third sidewall 113; and the bottom wall 107 may include the first and second upward extending tab 119 along the edge opposing the fourth sidewall 115.

FIG. 3 illustrates a movement limiting device 121 which may be positioned on the back surface and along a side edge of the top wall 105, illustrates a movement limiting device 121 (a substantial mirror) which may be positioned on the back surface and the along a side edge of the first sidewall 109, a movement limiting device 121 (a substantial mirror) which may be positioned on the back surface and the along a side edge of the second sidewall 111, a movement limiting device 121 (a substantial mirror) which may be positioned on the back surface and along a side edge of the third sidewall 113 and a movement limiting device 121 (a substantial mirror) which may be positioned on the back surface and along a side edge of the fourth sidewall 115.

Figure 4:
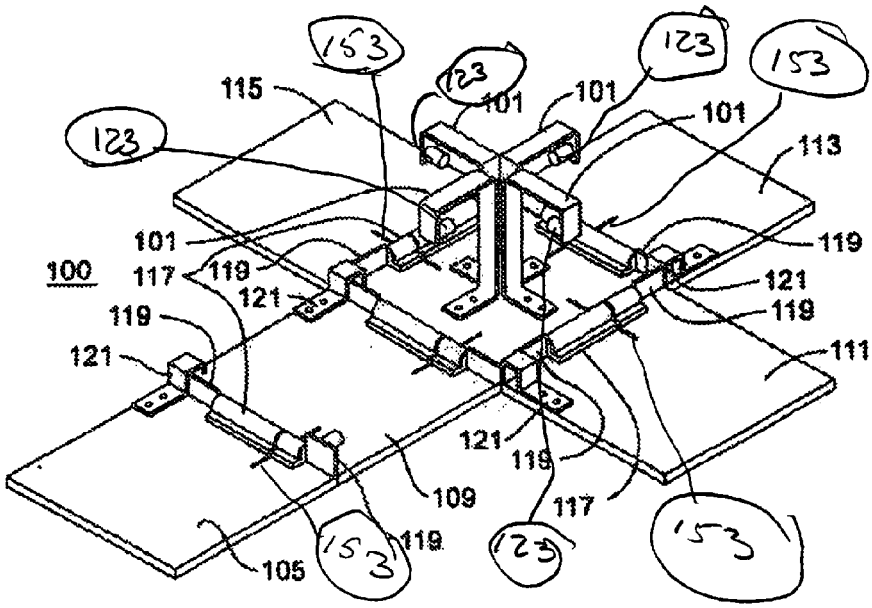
FIG. 4 illustrates a perspective view of the cross device of the present invention in the first position.

FIG. 4 illustrates a perspective view of the device 100 and illustrates a multitude of central frame members 101 for example FIG. 4 illustrates four central frame members 101 which are positioned adjacent and opposed at a substantially a 90° angle and 180° angle respectively with respect to a substantially mirror central frame member 101.

FIG. 4 additionally illustrates a hinge 117 which may be substantially a mirrored hinge 117 which may pivotably connected the top wall 105 and which may pivotably connect the first sidewall 109 with the bottom wall 107 and which may pivotably connect the second sidewall 111 with the bottom wall 107 and may pivotably connect the third sidewall 113 with the bottom wall 107 and may pivotably connect the fourth sidewall 115 with the bottom wall 107.

FIG. 4 additionally illustrates that the first sidewall 109 may include first and second upward extending tab 119 along the edge opposing the top sidewall 105; the bottom wall 107 may include another first and second upward extending tab 119 (a mirror) along the edge opposing the first sidewall 109; the bottom wall 107 may include another first and second upward extending tab 119 (a mirror) along the edge opposing the second sidewall 111; the bottom wall 107 may include the first and second upward extending tab 119 along the edge opposing the third sidewall 113; and the bottom wall 107 may include the first and second upward extending tab 119 along the edge opposing the fourth sidewall 115.

FIG. 4 illustrates a movement limiting device 121 which may be positioned on the back surface and along a side edge of the top wall 105, illustrates a movement limiting device 121 (a substantial mirror) which may be positioned on the back surface and the along a side edge of the first sidewall 109, a movement limiting device 121 (a substantial mirror) which may be positioned on the back surface and the along a side edge of the second sidewall 111, a movement limiting device 121 (a substantial mirror) which may be positioned on the back surface and along a side edge of the third sidewall 113 and a movement limiting device 121 (a substantial mirror) which may be positioned on the back surface and along a side edge of the fourth sidewall 115.

Figure 5:
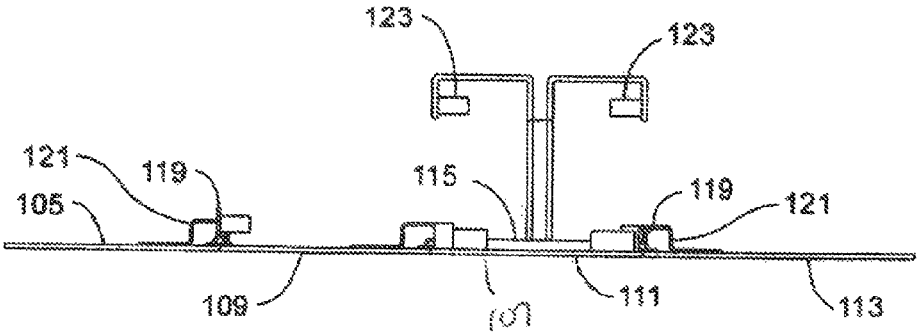
FIG. 5 illustrates a side view of the cross device of the present invention in a first position.

FIG. 5 illustrates a side view and illustrates the device 100 in a first position which being viewed from the back illustrates the cross. FIG. 5 illustrates a top wall 105 which may be pivotably connected to a first sidewall 109 and may be adjacent to the second sidewall 111, the third sidewall 113 and the fourth sidewall 115.

FIG. 5 additionally illustrates the central frame member 101, the upward extending tab 119 and the movement limiting device 121.

FIG. 5 illustrates a fastener 123 which may be a magnet and which may be connected to the central frame member 101 in order to magnetically fasten the central frame member 101 to the first sidewall 109, to magnetically fasten the central frame member 101 to the second sidewall 111, to magnetically fasten the central frame member 101 to the third sidewall 113 and two magnetically fasten the central frame member 101 to the fourth sidewall 115.

Figure 8:
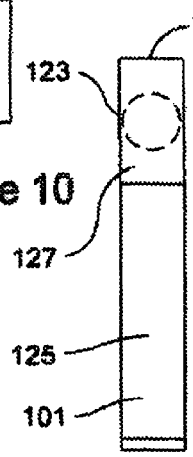
FIG. 8 illustrates a front view of the central frame member of the cross device.
Figure 7:
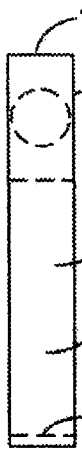
FIG. 7 illustrates a back view of the central frame member of the cross device.
Figure 6:
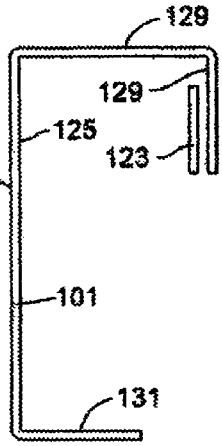
FIG. 6 illustrates a side view of the central frame member of the cross device.

FIG. 8 illustrates a front view of the central frame member 101 and may include a downward extending arm 127 which may be magnetically connected to the fastener 123 and which may be connected to an outward extending arm 129 which may be at a substantial perpendicular angle to the downward extending arm 127 and which may be connected to an upward extending arm 125 which may be at a substantial perpendicular angle to the outward extending arm 129. The upward extending arm 125 may be connected to a base arm 131 which may be a substantial perpendicular angle to the upward extending arm 125. FIG. 8 additionally illustrates the fastener 123 magnetically connected to the downward extending arm 127. FIG. 7 illustrates a back view of the central frame member 101 and may include a downward extending arm 127 which may be magnetically connected to the fastener 123 and which may be connected to an outward extending arm 129 which may be at a substantial perpendicular angle to the downward extending arm 127 and which may be connected to an upward extending arm 125 which may be at a substantial perpendicular angle to the outward extending arm 129. The upward extending arm 125 may be connected to a base arm 131 which may be a substantial perpendicular angle to the upward extending arm 125. FIG. 7 additionally illustrates the fastener 123 magnetically connected to the downward extending arm 127.

FIG. 7 illustrates a back view of the central frame member 101 and may include a downward extending arm 127 which may be magnetically connected to the fastener 123 and which may be connected to an outward extending arm 129 which may be at a substantial perpendicular angle to the downward extending arm 127 and which may be connected to an upward extending arm 125 which may be at a substantial perpendicular angle to the outward extending arm 129. The upward extending arm 125 may be connected to a base arm 131 which may be a substantial perpendicular angle to the upward extending arm 125. FIG. 7 additionally illustrates the fastener 123 magnetically connected to the downward extending arm 127.

Figure 9:
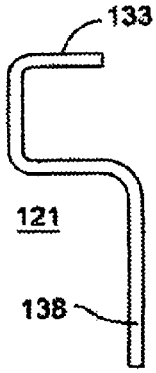
FIG. 9 illustrates a side view the movement limiting device of the cross device.

FIG. 9 illustrates a side view of the movement limiting device 121 of the present invention which may include a substantial C-section 133 which may be connected to a arm 135 which may be connected to the top wall 105 and which may be connected to the first sidewall 109 and which may be connected to a second sidewall 111 and which may be connected to the third sidewall 113 and which may be connected to the fourth sidewall 115. The interior surface of the C-section may cooperate with the upward extending tab 119 to prevent movement so that the device 100 is held in the first position.

Figure 10:
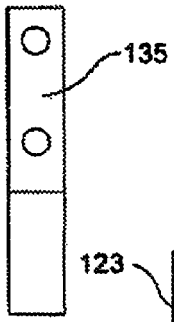
FIG. 10 illustrates a top view of the movement limiting device of the cross device of the present invention.

FIG. 10 illustrates a top view of the movement limiting device 121 of the present invention which may include a substantial C-section 133 which may be connected to a arm 135 which may be connected to the top wall 105 and which may be connected to the first sidewall 109 and which may be connected to a second sidewall 111 and which may be connected to the third sidewall 113 and which may be connected to the fourth sidewall 115. The interior surface of the C-section may cooperate with the upward extending tab 119 to prevent movement so that the device 100 is held in the first position.

FIG. 11 illustrates a perspective view of the bottom wall 107 and illustrates a first upward extending tab 119*a* and a second upward extending tab 119*b* positioned along the edge of the bottom wall 107. FIG. 11 illustrates the bottom wall 107 as a rectangle, but the bottom wall 107 could be other shapes. The bottom wall 107 is illustrated as having a first upward extending tab 119*a* and a second upward extending tab 119*b* along each edge of the bottom wall 107 and defining a depression 141 to cooperate with the hinge member 117 (not illustrated in FIG. 11) and defining a corner notch 143.

FIG. 12 illustrates a bottom view of the bottom wall 107 and illustrates a first upward extending tab 119*a* and a second upward extending tab 119*b* positioned along the edge of the bottom wall 107. FIG. 12 illustrates the bottom wall 107 as a rectangle, but the bottom wall 107 could be other shapes. The bottom wall 107 is illustrated as having a first upward extending tab 119*a* and a second upward extending tab 119*b* along each edge of the bottom wall 107 and defining a depression 141 to cooperate with the hinge member 117 (not illustrated in FIG. 12) and defining a corner notch 143.

FIG. 13 illustrates a side view of the bottom wall 107 and illustrates a first upward extending tab 119*a* and a second upward extending tab 119*b* positioned along the edge of the bottom wall 107. FIG. 13 illustrates the bottom wall 107 as a rectangle, but the bottom wall 107 could be other shapes. The bottom wall 107 is illustrated as having a first upward extending tab 119*a* and a second upward extending tab 119*b* along each edge of the bottom wall 107 and defining a depression 141 to cooperate with the hinge member 117 (not illustrated in FIG. 13) and defining a corner notch 143.

FIG. 14 illustrates a another side view of the bottom wall 107 and illustrates a first upward extending tab 119*a* and a second upward extending tab 119*b* positioned along the edge of the bottom wall 107. FIG. 12 illustrates the bottom wall 107 as a rectangle, but the bottom wall 107 could be other shapes. The bottom wall 107 is illustrated as having a first upward extending tab 119*a* and a second upward extending tab 119*b* along each edge of the bottom wall 107 and defining a depression 141 to cooperate with the hinge member 117 (not illustrated in FIG. 12) and defining a corner notch 143.

Figure 15:
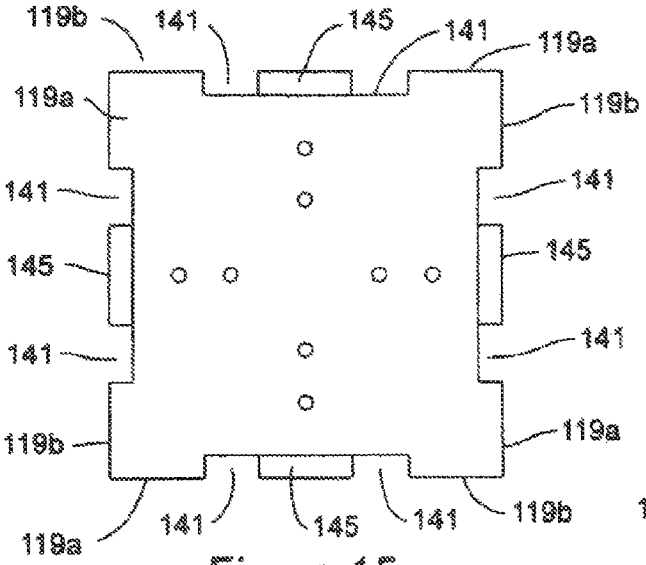
FIG. 15 illustrates a top view of another embodiment of the bottom wall of the cross device of the present invention.

FIG. 15 illustrates a another side view of another bottom wall 107*a* and illustrates a first upward extending tab 119*a* and a second upward extending tab 119*b* positioned along the edge of the bottom wall 107. FIG. 15 illustrates the bottom wall 107*a* as a rectangle, but the bottom wall 107*a* could be other shapes. The bottom wall 107*a* is illustrated as having a first upward extending tab 119*a* and a second upward extending tab 119*b* along each edge of the bottom wall 107 and defining a depression 141 to cooperate with the hinge member 117 (not illustrated in FIG. 15) and defining a corner notch 143. FIG. 15 additionally illustrates a cylinder 145 having a central aperture 147 connected to the edge of the bottom wall 107*a*.

Figure 16:
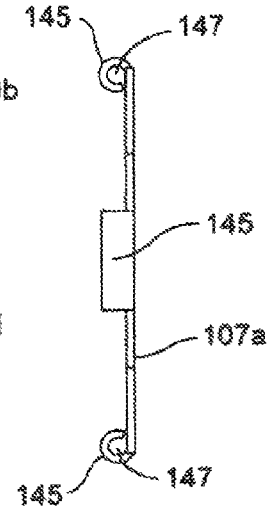
FIG. 16 illustrates a side view of the another embodiment of the bottom wall of the cross device of the present invention.

FIG. 16 illustrates a side view of the bottom wall 107 and additionally illustrates a cylinder 145 having a central aperture 147 connected to the edge of the bottom wall 107.

Figure 17:
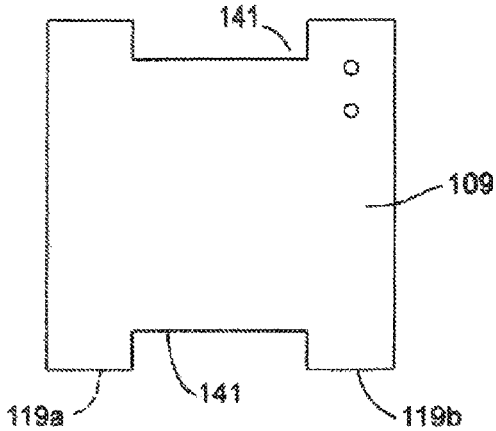
FIG. 17 illustrates a top view of the first sidewall of the cross device of the present invention.

FIG. 17 illustrates a top view of the first sidewall 109 and illustrates a depression 141 in opposing edges of the first sidewall 109. FIG. 17 additionally illustrates the first upward extending tab 119*a* and the second upward extending tab 119*b*.

Figure 18:
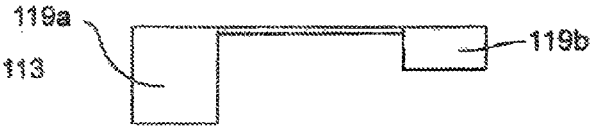
FIG. 18 illustrates a front view of the first sidewall of the cross device of the present invention.

FIG. 18 illustrates a top view of the first sidewall 109 and illustrates a depression 141 in opposing edges of the first sidewall 109. FIG. 18 additionally illustrates the first upward extending tab 119*a* and the second upward extending tab 119*b*.

Figure 19:
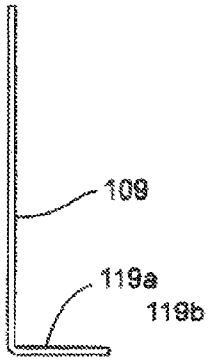
FIG. 19 illustrates a side view of the first sidewall of the cross device of the present invention.

FIG. 19 illustrates a side view of the first sidewall 109 and illustrates the first upward extending tab 119*a* and the second upward extending tab 119*b*.

Figure 20:
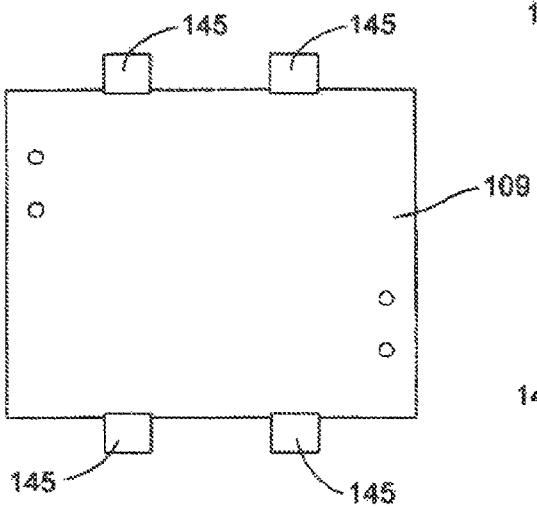
FIG. 20 illustrates a top view of another embodiment of the first sidewall of the cross device of the present invention.

FIG. 20 illustrates a top view of another embodiment of the first sidewall 109 and illustrates a first and second cylinder 145 on opposing edges of the first sidewall 109.

Figure 21:
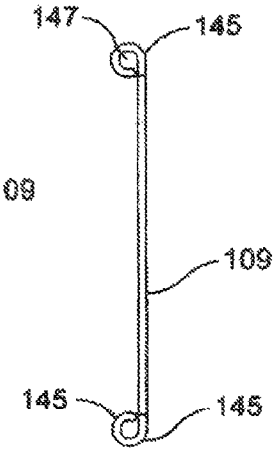
FIG. 21 illustrates a side view of the another embodiment of the first sidewall of the cross device of the present invention.

FIG. 21 illustrates a side view of the first sidewall 109 and illustrates that the first and second cylinder 145 includes apertures 147 which extend through the first and second cylinder 145 to cooperate with the hinge (not illustrated in FIG. 21).

FIG. 22-25 illustrates embodiments that are equally applicable to the top wall 105, the second sidewall 111, the third sidewall 113 and the fourth sidewall 115. The figures will be explained with respect to the top wall 105, but they apply equally to the above walls.

Figure 22:
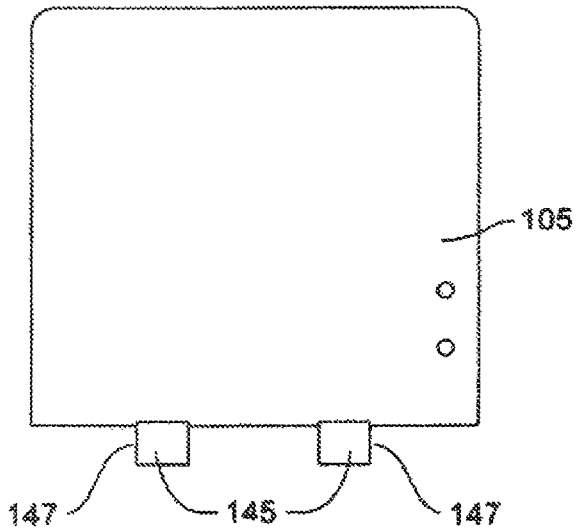
FIG. 22 illustrates a top view of the top wall, the second sidewall, the third sidewall, and the fourth sidewall of the cross device of the present invention.

FIG. 22 illustrates a top view of the top wall 105, and the top wall 105 may include a pair of cylinders 145 which may include a central aperture 147 to cooperate with a hinge member 117 (not shown in FIG. 22).

Figure 23:
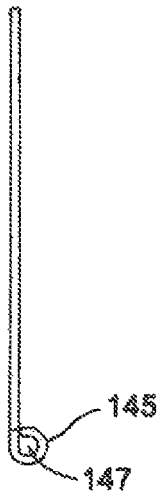
FIG. 23 illustrates a side view of the top wall, the second sidewall, the third sidewall and the fourth sidewall of the cross device of the present invention.

FIG. 23 illustrates a side view of the top wall 105, and the top wall 105 may include a pair of cylinders 145 which may include a central aperture 147 to cooperate with a hinge member 117 (not shown in FIG. 23).

Figure 24:
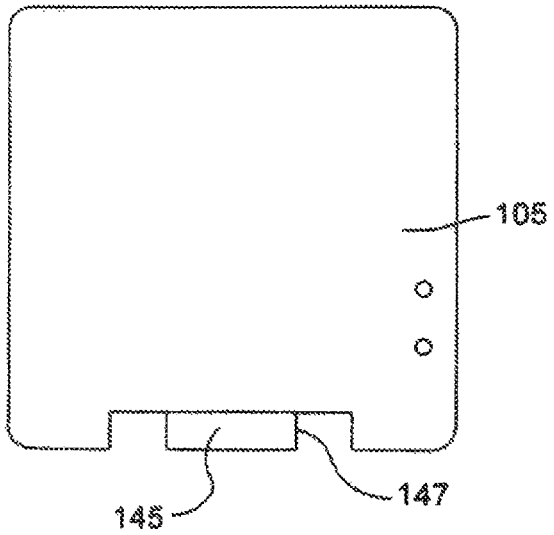
FIG. 24 illustrates a top view of another embodiment of the top wall, the second sidewall, the third sidewall and the fourth sidewall of the cross device of the present invention.

FIG. 24 illustrates a top view of another embodiment of the top wall 105, and the top wall 105 may include a pair of cylinders 145 which may include a central aperture 147 to cooperate with a hinge member 117 (not shown in FIG. 24).

Figure 25:
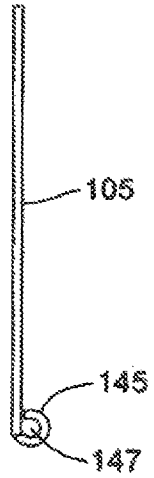
FIG. 25 illustrates a side view of another embodiment of the top wall, the second sidewall, the third sidewall, and the fourth sidewall.

FIG. 25 illustrates a side view of the top wall 105, and the top wall 105 may include a pair of cylinders 145 which may include a central aperture 147 to cooperate with a hinge member 117 (not shown in FIG. 25).

Figure 26:
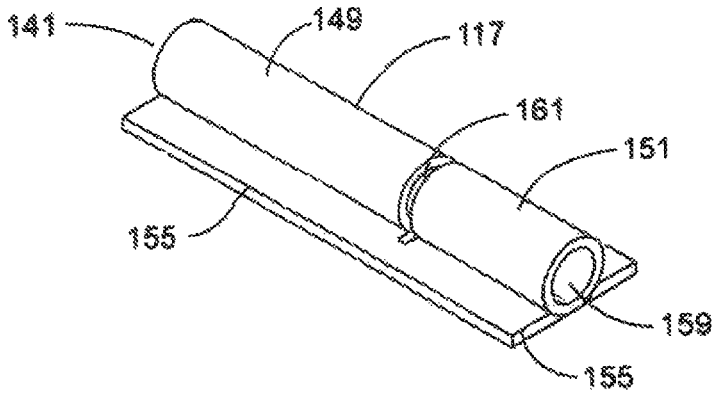
FIG. 26 illustrates a perspective view of the hinge member of the cross device of the present invention.

FIG. 26 illustrates a perspective view of the hinge member 117 which may include a first cylinder 149 mounted on a base 155 and adjacent to a second cylinder 151. The first cylinder 141 may have a central aperture 157, and the second cylinder 151 may have a central aperture 159 being substantially aligned with the central aperture 157 of the first cylinder 141. The first cylinder 141 and the second cylinder 151 may define a slit 161. The slit 161 may cooperate with a biasing device 153 which may be a spring in order to bias the hinge member 117.

Figure 27:
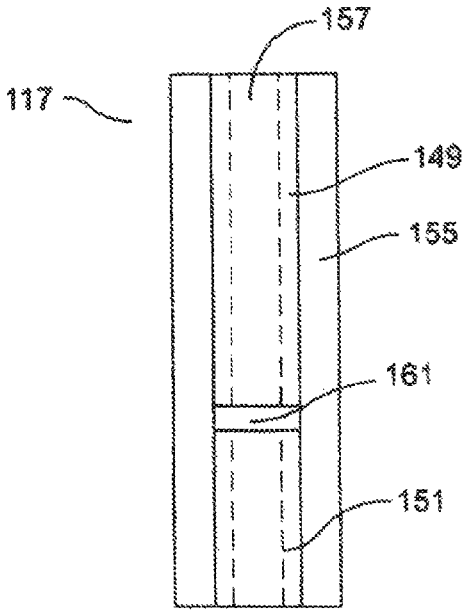
FIG. 27 illustrates a top view of the hinge member of the cross device of the present invention.

FIG. 27 illustrates a top view of the hinge member 117 which may include a first cylinder 149 mounted on a base 155 and adjacent to a second cylinder 151. The first cylinder 141 may have a central aperture 157, and the second cylinder 151 may have a central aperture 159 being substantially aligned with the central aperture 157 of the first cylinder 141. The first cylinder 141 and the second cylinder 151 may define a slit 161. The slit 161 may cooperate with a biasing device 153 which may be a spring in order to bias the hinge member 117.

Figure 28:
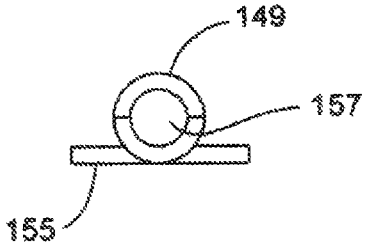
FIG. 28 illustrates a side view of the hinge member of the cross device of the present invention.

FIG. 28 illustrates an end view of the hinge member 117 and illustrates the base 115 the first cylinder 149 and a central aperture 157.

Figure 29:
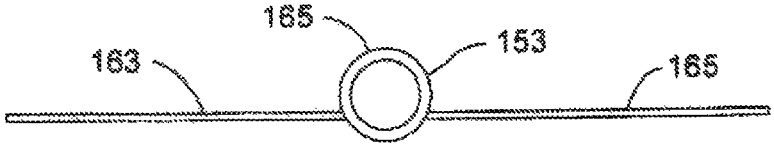
FIG. 29 illustrates a cross-sectional view of the biasing device of the hinge member of the present invention.

FIG. 29 illustrates an end view of the biasing device 153 which may include a spring having arms 163 and a coiled center 165.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A cross device, comprising:

a bottom wall;

a first sidewall being pivotably connected with an hinge, a first fastener to magnetically fasten to the bottom wall and a first biasing device to bias the first sidewall and to cooperate with the magnetic first fastener;

a second sidewall being pivotably connected with an hinge, a second fastener to magnetically fasten to the bottom wall and a second biasing device to bias the second sidewall and to cooperate with the magnetic second fastener;

a third sidewall being pivotably connected with an hinge, a third fastener to magnetically fasten to the bottom wall and a third biasing device to bias the third sidewall and to cooperate with the magnetic third fastener;

a fourth sidewall being pivotably connected with an hinge, a fourth fastener to magnetically fasten to the bottom wall and a fourth biasing device to bias the fourth sidewall and to cooperate with the fourth fastener and to cooperate with the magnetic fourth fastener;

a top wall being pivotably connected with an hinge, a fifth fastener to magnetically fasten to the first sidewall and a fifth biasing device to bias the top wall and to cooperate with the magnetic fifth fastener;

wherein the cross device is movable between a first position in the form of a cross and a second position in the form of a rectangle.

2. A cross device as in claim 1, wherein the top wall is detachably connected to a central frame member.

3. A cross device as in claim 1, wherein the first sidewall is detachably connected to a central frame member.

4. A cross device as in claim 1, wherein the second sidewall is detachably connected to a central frame member.

5. A cross device as in claim 1, wherein the third sidewall is detachably connected to a central frame member.

6. A cross device as in claim 1, wherein the fourth sidewall is detachably connected to a central frame member.

* * * * *